US005353603A

United States Patent [19]

Outlaw et al.

[11] Patent Number: 5,353,603

[45] Date of Patent: Oct. 11, 1994

[54] DUAL REFRIGERANT RECOVERY APPARATUS WITH SINGLE VACUUM PUMP AND CONTROL MEANS

[75] Inventors: George R. Outlaw, Arlington; Fred L. Ptacek, Joshua; Charles R. Smith, Grapevine; Steven R. Kouzes, Southlake, all of Tex.

[73] Assignee: Wynn's Climate Systems, Inc., Fort Worth, Tex.

[21] Appl. No.: 200,647

[22] Filed: Feb. 23, 1994

[51] Int. Cl.[5] ..... F25B 45/00

[52] U.S. Cl. ..... 62/149; 62/292

[58] Field of Search ..... 62/77, 85, 149, 292, 62/475, 335

[56] References Cited

U.S. PATENT DOCUMENTS 4,939,905 7/1990 Hanz ..... 62/292

5,165,253 11/1992 Kamegasawa et al. ..... 62/292

*Primary Examiner*—John M. Sollecito

*Attorney, Agent, or Firm*—James E. Bradley

[57] ABSTRACT

A refrigerant recovery assembly will recover incompatible refrigerants. The assembly has two separate processing units. Each unit has a pair of hoses which connect to an air conditioning system for recovering refrigerant. Each unit has an expansion valve, an evaporator, a compressor, a condenser and one or more filters. The two units are mounted on a single frame and utilize common electrical controls. The electrical controls will not allow each unit to operate simultaneously. A single vacuum pump is used with each unit.

9 Claims, 2 Drawing Sheets

DUAL REFRIGERANT RECOVERY APPARATUS WITH SINGLE VACUUM PUMP AND CONTROL MEANS

BACKGROUND OF THE INVENTION

1. Field of the Invention:

This invention relates in general to refrigerant recovery devices, and in particular to an apparatus that will recover two incompatible types of refrigerant.

2. Description of the Prior Art:

A typical prior art refrigerant recovery apparatus has a pair of hoses that will connect to the high and low pressure sides of the compressor of an air conditioning system. The recovery unit has an expansion valve which expands any liquid components being recovered into a gaseous refrigerant. An evaporator adds heat to the cold gaseous refrigerant. A compressor connects to the evaporator for compressing the refrigerant in the gaseous state. The hot gaseous refrigerant at the exit of the compressor passes through a condenser, where it is condensed to a warm liquid. The warm liquid refrigerant flows into a storage tank for later use. Filters located in the unit filter foreign matter such as particles and water moisture. Additionally, oil will be separated by an oil separator in the recovery unit. The oil will be measured so that the same amount can later be reintroduced.

Many recovery units also have the capability of recharging the air conditioning system with refrigerant. The recharging features include a vacuum pump for evacuating the system to a level substantially below the vacuum level achieved by the operation of the recovery unit compressor. Then, a valve is opened to flow refrigerant from the storage container into the air conditioning system.

The prior art type of refrigerant was harmful to the ozone layer if released into the atmosphere. Recent regulations will prohibit the future manufacture of the prior art type, which typically was called "R-12". New air conditioning systems for vehicles now employ a different refrigerant, called "R-134A". That refrigerant is much less harmful to the ozone layer than the prior refrigerant, thus will eventually replace the prior refrigerant type.

Meanwhile, however, there are millions of vehicles and other types of air conditioning systems using the prior art type of refrigerant. These systems need to be maintained and repaired. Also, many of the systems will eventually be retrofitted so that they can use the new type of refrigerant. A retrofit generally requires new seals and hoses.

The existing refrigerant recovery units will not recover both R-12 and R-134A because these refrigerants are incompatible. The oil contained within the R-12 refrigerant would contaminate the hoses and seals of the recovery unit such that the recovery unit would not be able to recover and clean R-134A refrigerant. Repair shops need to have the ability to recover both types of refrigerants. In the prior art, this requires purchasing two stand alone recovery units, adding additional equipment expense.

SUMMARY OF THE INVENTION

In this invention, a refrigerant recovery apparatus will recover incompatible types of refrigerants, such as R-12 and R-134A. The apparatus has two separate processing units. Each unit has a pair of hoses which will connect to an air conditioning system for recovering refrigerant. Each unit has an expansion valve, an evaporator, a compressor and a condenser. Each unit has a screen filter, as well as a moisture filter. Also, each unit has an oil separator for recovering oil from the refrigerant.

The two refrigerant units share a single vacuum pump which is of an oil-less type, so that it can be used to evacuate either an R-12 system or an R-134A system. The vacuum pump is connected to both pairs of hoses of the two separate processing units. Valve means will selectively control the vacuum pump for drawing a vacuum through one set of hoses or the other set of hoses.

Also, the two processing units share common electrical controls. A power switch has one position which will supply power to the R-134A processing unit, and another position which will supply power to the R-12 processing unit. A single set of function select switches connect to a control board, which controls both processing units. The function select switches include switches for recovery, evacuate and recharge. Depending upon the position of the power switch, the control board function switches will control one or the other processing unit.

DETAILED DESCRIPTION OF THE INVENTION

Figure 1:
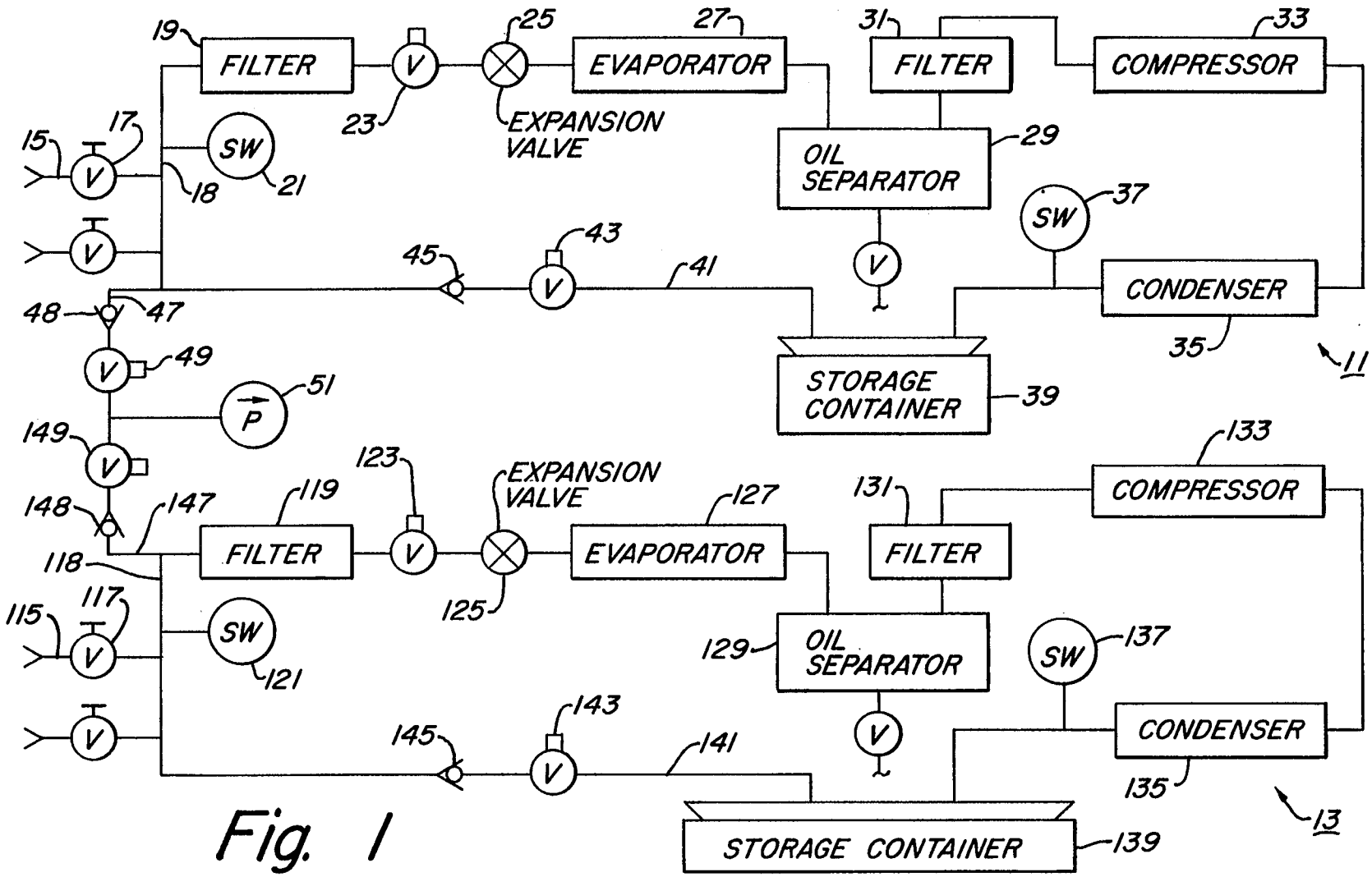
FIG. 1 is a schematic representing the flow lines and components of a refrigerant recovery apparatus constructed in accordance with this invention.

Referring to FIG. 1, the recovery apparatus has two processing units 11, 13. Processing unit 11 may be used for recovering one refrigerant, such as R-12 refrigerant. Processing unit 13 may be used for recovering an incompatible refrigerant such as R-134A. The components of the processor unit 13 are identical to those of processor unit 11 and will numbered the same except for the number "1" in front of each component number.

Processor units 11, 13 each have a separate pair of hoses 15, 115. Hoses 15, 115 connect to air conditioning systems (not shown) for recovering refrigerant. One of the hoses 15 will connect to the high pressure side of the air conditioning system compressor, while the other connects to the low pressure side of the air conditioning system compressor. Manual valves 17, 117 are used to open and close the hoses 15, 115. The hoses 15, 115 lead to inlet lines 18, 118 of each processor unit 11, 13.

Screen filters 19, 119 are located in inlet lines 18, 118, respectively. Filters 19, 119 screen particles and debris from the recovered refrigerant. Low pressure switches 21, 121 monitor the pressure in the inlet lines 18, 118. Solenoid actuated inlet valves 23, 123 connect to the inlet lines 18, 118, normally downstream from filters 19, 119. When supplied with electrical power, inlet valves 23, 123 open inlet lines 18, 118. Expansion valves 25, 125 are positioned downstream of inlet valves 23, 123. Expansion valves 25, 125 expand any liquid components contained in the refrigerant being recovered.

Evaporators 27, 127 are connected to expansion valves 25, 125 for conventionally adding heat to the cold gaseous refrigerant. Oil separators 29, 129 locate downstream from evaporators 27, 127 for recovering droplets of oil. Each oil separator 29, 129 has a drain for draining oil and measuring it for reintroduction subsequently. Moisture separators or filters 31, 131 connect to the outlet of oil separators 29, 129 for further filtering, particularly removing moisture from the refrigerant. Moisture filters 31, 131 connect to compressors 33, 133.

Compressors 33, 133 compress the dry gaseous refrigerant into a hot, high pressure gaseous refrigerant. This refrigerant flows to condensers 35, 135 for condensing into a liquid. High pressure switches 37, 137 locate at the outlets of condensers 35, 135 for monitoring pressure at the outlets of condensers 35, 135.

The outlet of each condenser 35, 135 leads to a storage container 39, 139. Each storage container 39, 139 has an outlet line 41, 141 leading from the lower portion of the container 39, 139 back to the inlet lines 18, 118. Solenoid actuated outlet valves 43, 143 are normally closed, but when electrically actuated, will open the outlet lines 41, 141. Check valves 45, 145 prevent backflow into the storage container through outlet lines 41, 141.

A vacuum line 47 connects to inlet line 18, while a vacuum line 147 connects to inlet line 118. Vacuum lines 47, 147 both lead to a single vacuum pump 51. Check valves 48, 148 allow flow toward vacuum pump 51, but not in a reverse direction. Solenoid actuated vacuum valves 49, 149 are normally closed, but will selectively open the vacuum lines 47, 147 when energized. Vacuum pump 51 is of a type that does not use any lubricating oil, which otherwise would be contaminated with minute amounts of refrigerant. Vacuum pump 51 can evacuate air conditioning systems having incompatible refrigerants without contaminating them. Vacuum pump 51 is operated only after substantially all of the refrigerant has been withdrawn by one of the compressors 33, 133.

Figure 2:
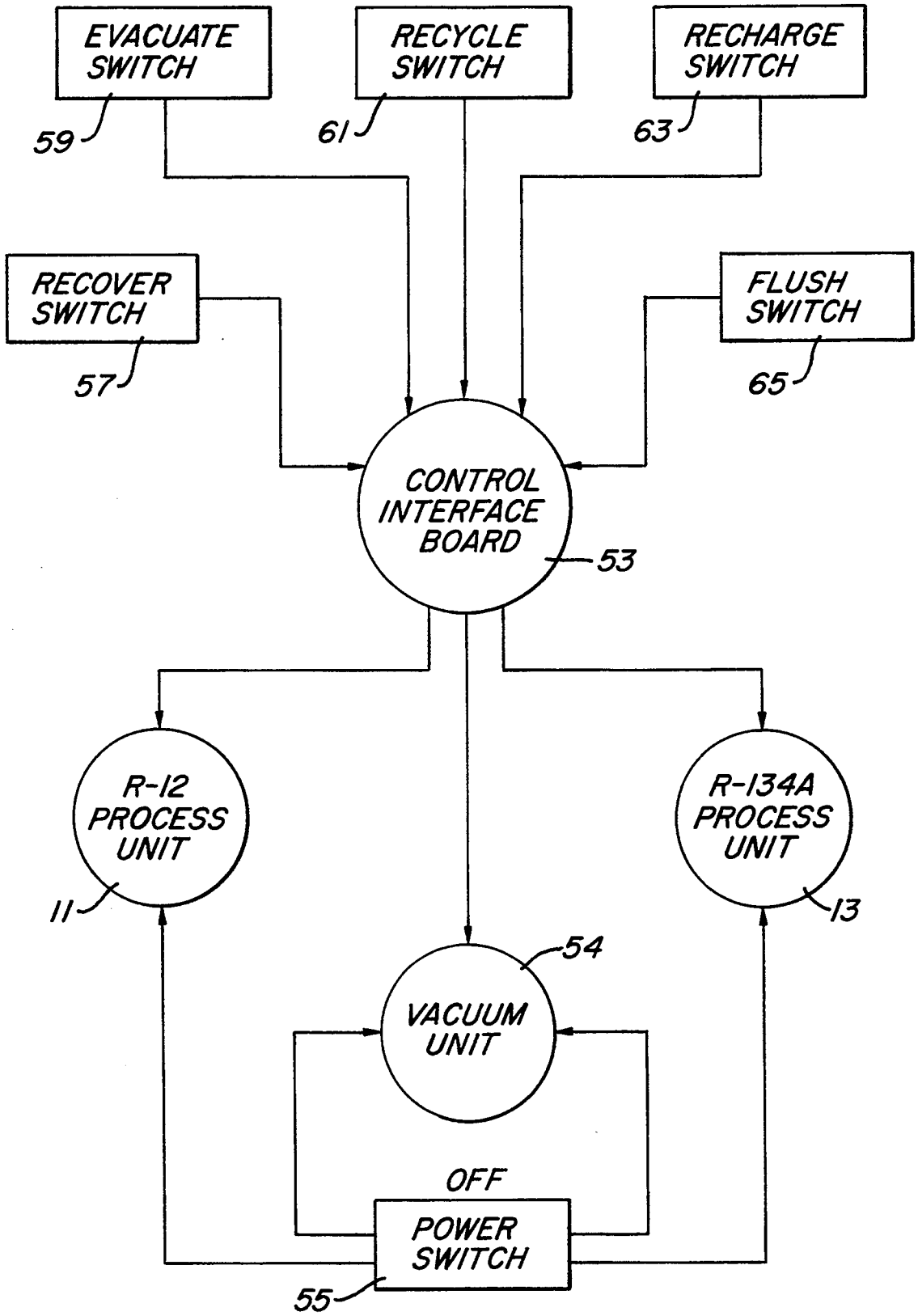
FIG. 2 is an electrical schematic for the recovery apparatus of FIG. 1.

Referring now to FIG. 2, the processing units 11, 13 share common electrical controls. Control interface board 53 connects to both processing units 11, 13, and to vacuum unit 54, which includes vacuum valves 49, 149, and vacuum pump 51. Similarly, a refrigerant select power switch 55, connected to alternating current power, has lines reading to both processing units 11, 13, and vacuum unit 54. Power switch 55 is of a type that has a central neutral position, in which no power is supplied to either processing unit 11, 13 nor to vacuum unit 54. Power switch 55 may be switched to the left or R-12 position, in which case it will supply power to processing unit 11 and to vacuum unit 54. No power will be supplied to processing unit 13 when power switch 55 is toggled to the R-12 position. When toggled to the right, or the R-134A position, power switch 55 will supply power to processing unit 13 as well as vacuum unit 54.

Control board 53 has incorporated with it a number of function select switches. These include a recover switch 57, an evacuate switch 59, a recycle switch 61, a recharge switch 63, and a flush switch 65. Depressing one of the select switches 57, 59, 61, 63 and 65 will provide a signal simultaneously to certain components of both processing units 11, 13 to perform the selected mode. However only the processing unit 11, 13 that has been supplied with power from power switch 55 will perform the selected function. The processing units 11, 13 cannot operate simultaneously.

In operation, assume that an air conditioning system has previously been charged with refrigerant R-12. The operator will connect the hoses 15 to the system and open valve 17. The operator will shift power switch 55 to the R-12 position, which provides electrical power only to vacuum unit 49 and processing unit 11. The operator then depresses recovery switch 57, which causes compressor 33 to begin operating and opens normally closed inlet valve 23. Outlet valve 43 and vacuum valve 49 will be closed and vacuum pump 51 will not be operating even though power is supplied by power switch 55. Vacuum unit 54 operates only when the evacuate switch 59 is selected.

The refrigerant flows through filter 19, expansion valve 25 and through evaporator 27. Oil is separated by oil separator 29. Moisture is removed from the refrigerant by filter 31. Compressor 33 compresses the refrigerant, which flows through condenser 35 and into storage container 39. A single pass through the filters 19, 31 is adequate to clean the refrigerant.

The recovery process continues until a selected time interval or a minimum pressure is indicated by low pressure switch 21. The minimum pressure will be a vacuum level, below atmospheric, such as five inches of mercury. At that point, compressor 33 will be turned off and inlet valve 23 will close.

If the operator wishes to flush the air conditioning system to remove additional debris and foreign matter, he will then depress flush switch 65. Flush switch 65 opens outlet valve 43 while keeping inlet valve 23 closed. The refrigerant from storage container 39 flows substantially as a liquid into both high and low sides of the air conditioning system. Compressor 33 will be energized, applying pressure to storage container 39 as refrigerant flows out outlet line 41 into both of the hoses 15. The refrigerant does not circulate through the air conditioning system.

Compressor 33 will continue to operate until a selected maximum pressure is reached, as indicated by high pressure switch 37, or a selected time interval, whichever occurs first. Then, without stopping compressor 33, the system will automatically switch back to the recover mode, with outlet valve 43 closing and inlet valve 23 opening. Refrigerant flows back through hoses 15 and is recovered in the same manner. As the refrigerant flows back, it will be substantially in a liquid state, bringing along with it debris and other foreign matter for filtering by filters 19 and 31.

After the operator has performed the desired maintenance on the air conditioning system, he normally will wish to recharge the system. To recharge with R-12 refrigerant, the operator will then evacuate the system by pressing evacuate switch 59. Power switch 55 will remain in the R-12 position. Control interface board 53 will open vacuum valve 49 and turn on vacuum pump 51. Inlet and outlet valves 23, 43 remain closed. Compressor 33 will not be running. Vacuum pump 51 will draw the air conditioning system down to a greater vacuum than previously was capable during the recover mode by compressor 33. When the desired level of vacuum has been reached, vacuum valve 49 closes and vacuum pump 51 ceases to run.

Then operator depresses recharge switch 63. Solenoid valve outlet valve 43 opens to allow refrigerant to flow from storage container 39 into the system. Compressor 33 will not be operating at this point. A metered amount of refrigerant, measured by the decreasing weight of container 39, which rests on a scale, will be allowed to flow into the system. Oil will be injected separately in a measured amount by a separate injection system (not shown). Once recharged, the outlet valve 43 closes. Manual valves 17 are closed and the hoses 15 are disconnected.

Recycle switch 61 need not be employed in every operation, and is normally employed only to further pressurize storage container 39 before recharging. If recycle switch 61 is activated, manual valve 17 will be closed while inlet valve 23 and outlet valve 43 are open. Compressor 33 will be energized. This causes refrigerant to flow out of storage container 39, through inlet line 18 and back through expansion valve 25, evaporator 27, oil separator 29, and filter 31 to compressor 33. Compressor 33 compresses the refrigerant, which flows through condenser 35 into storage container 39. The cycle can be continued until a desired high pressure is reached as indicated by high pressure switch 37.

Processor unit 13 will operate in the same manner as described above. Power switch 55 prevents both units 11, 13 from operating simultaneously.

The invention has significant advantages. A single assembly, mounted on wheels, can be used to recover and recharge refrigerant from air conditioning systems having incompatible types of refrigerant. By using a common vacuum pump and common electrical controls, the apparatus is less expensive than having two completely separate stand alone units.

While the invention has been shown in only one of its forms, it should be apparent to those skilled in the art that it is not so limited, but is susceptible to various changes without departing from the scope of the invention.

I claim:

1. A refrigerant recovery apparatus for recovering incompatible first and second refrigerants, comprising in combination:

first and second refrigerant processing units, each unit having a pair of hoses adapted to be connected to an air conditioning system for recovering refrigerant, an expansion valve communicating with the hoses for converting any liquid contained in the refrigerant into a gaseous state, an evaporator connected to the expansion valve for adding heat to the refrigerant, an oil separator connected to the evaporator for removing oil from the refrigerant, a filter connected to the oil separator for removing moisture and foreign matter from the refrigerant, a compressor connected to the filter for recovering refrigerant from the air conditioning system and compressing the refrigerant, a condenser connected to the compressor for condensing the refrigerant, a storage container connected to the condenser for storing the refrigerant, an outlet conduit leading from the storage container to the pair of hoses, and an outlet valve connected into the outlet conduit;

a single vacuum pump connected to both pairs of hoses; and vacuum pump valve means for selectively controlling the vacuum pump for evacuating one of the air conditioning systems after refrigerant has been recovered by one of the refrigerant processing units, so that one of the outlet valves may then be opened to recharge said one of the air conditioning systems.

2. The apparatus according to claim 1 further comprising:

a single electrical recover function select switch connected to both of the units;

a single electrical evacuate function select switch connected to the vacuum pump;

a single power switch connected to both of the units, having a first refrigerant position and a second refrigerant position for selectively applying electrical power to one of the units; and control board means connected to the function select switches and to the power switch, for selectively controlling the units and the vacuum pump in response to the operator's selection of one of the function select switches and the selection of the position of the power switch.

3. A refrigerant recovery apparatus for recovering incompatible first and second refrigerants, comprising in combination:

a first refrigerant processing unit, comprising:

a first pair of hoses adapted to be connected to a first air conditioning system containing a first refrigerant for recovering the first refrigerant;

a first screen filter connected to the first pair of hoses for filtering particles from recovered first refrigerant;

a first expansion valve connected to the first screen filter for converting any liquid contained in the first refrigerant into a gaseous state;

a first evaporator connected to the first expansion valve for adding heat to the first refrigerant flowing from the first expansion valve;

a first oil separator connected to the first evaporator for removing oil from the first refrigerant;

a first moisture filter connected to the first oil separator for removing moisture and foreign matter from the first refrigerant;

a first compressor connected to the first moisture filter for compressing the first refrigerant flowing from the first moisture filter;

a first condenser connected to the first compressor for condensing the first refrigerant flowing from the first compressor into a liquid state;

a first storage container connected to the first condenser for storing the first refrigerant;

a first outlet conduit leading from the first storage container to the first pair of hoses; and a first storage outlet valve connected into the first outlet conduit;

a second refrigerant processing unit comprising:

a second pair of hoses adapted to be connected to a second air conditioning system containing a second refrigerant for recovering the second refrigerant;

a second screen filter connected to the second pair of hoses for filtering particles from recovered second refrigerant;

a second expansion valve connected to the second screen filter for converting any liquid contained in the second refrigerant into a gaseous state;

a second evaporator connected to the second expansion valve for adding heat to the second refrigerant flowing from the second expansion valve;

a second oil separator connected to the second evaporator for removing oil from the second refrigerant;

a second moisture filter connected to the second oil separator for removing moisture and foreign matter from the second refrigerant;

a second compressor connected to the second moisture filter for compressing the second refrigerant flowing from the second moisture filter;

a second condenser connected to the second compressor for condensing the second refrigerant flowing from the second compressor into a liquid state;

a second storage container connected to the second condenser for storing the second refrigerant;

a second outlet conduit leading from the second storage container to the second pair of hoses; and a second storage outlet valve connected into the second outlet conduit;

the apparatus further comprising:

a single vacuum pump connected to both the first and second pairs of hoses; and vacuum pump valve means for selectively controlling the vacuum pump for selectively evacuating one of the air conditioning systems after one of the refrigerants has been recovered by one of the units, so that one of the storage outlet valves may then be selectively opened to recharge said one of the air conditioning systems with said one of the refrigerants.

4. The recovery apparatus according to claim 3, further comprising:

a single electrical recover function select switch;

a single electrical evacuate function select switch;

refrigerant select switch means for selecting one of the units; and control board means connected to the function select switches, the refrigerant select switch means, the vacuum pump, and the vacuum pump valve means for selectively controlling the units and the vacuum pump in response to the operator's selection of one of the function select switches and the refrigerant select switch means.

5. The recovery apparatus according to claim 3, further comprising:

a first inlet valve mounted between the first pair of hoses and the first expansion valve;

a second inlet valve mounted between the second pair of hoses and the second expansion valve;

the inlet valves and the storage outlet valves being solenoid actuated;

a single electrical recover function select switch;

a single electrical evacuate function select switch;

a single electrical recharge function select switch;

a refrigerant select power switch having a first refrigerant position which supplies electrical power to the first unit and a second refrigerant position which supplies power to the second unit; and control board means connected to the function select switches, to the units, and to the refrigerant select power switch, for energizing only the first compressor, opening the first inlet valve and closing the first outlet valve when the recover function select switch is actuated and the refrigerant select power switch placed in the first refrigerant position, then for turning off the first compressor, closing the first inlet valve and energizing the vacuum pump and vacuum pump valve means when the evacuate function select switch is selected, then for turning off the vacuum pump and vacuum pump valve means and opening the first outlet valve to flow refrigerant from the first storage container into the first air conditioning system for recharge.

6. A refrigerant recovery apparatus for recovering incompatible first and second refrigerants, comprising in combination:

first and second refrigerant processing units, each unit having a pair of hoses adapted to be connected to an air conditioning system for recovering refrigerant, an expansion valve communicating with the hoses for converting any liquid contained in the refrigerant into a gaseous state, a solenoid actuated inlet valve connected between the pair of hoses and the expansion valve, an evaporator connected to the expansion valve for adding heat to the refrigerant, an oil separator connected to the evaporator for removing oil from the refrigerant, a filter connected to the oil separator for removing moisture and foreign matter from the refrigerant, a compressor connected to the filter for recovering refrigerant from the air conditioning system and compressing the refrigerant, a condenser connected to the compressor for condensing the refrigerant, a storage container connected to the condenser for storing the refrigerant, an outlet conduit leading from the storage container to the pair of hoses, and a solenoid actuated outlet valve connected into the outlet conduit;

a single vacuum pump connected by a first vacuum line to the pair of hoses of the first unit and a second vacuum line to the pair of hoses of the second unit; and solenoid actuated first and second vacuum valves connected in the first and second vacuum lines, respectively;

a single electrical recover function select switch connected to both of the processing units for operating a selected one of the processing units in a recover mode;

a single electrical evacuate function select switch connected to both of the processing units, to the vacuum pump and both of the vacuum valves for operating the vacuum pump in an evacuate mode selectively through one of the the first and second vacuum lines;

a single electrical recharge function select switch connected to both of the processing units for operating a selected one of the processing units in a recharge mode;

a refrigerant select switch having a first refrigerant position and a second refrigerant position and connected to both of the processing units, to the vacuum pump and to both of the vacuum valves for selecting one of the first and second processing units; and the function select switches and the refrigerant select switch being interconnected such that selecting the first refrigerant position and actuating the function select switches will operate only the first processing unit through recover, evacuate and recharge modes, and selecting the second refrigerant position and actuating the function select switches will operate only the second processing unit through recover, evacuate and recharge modes.

7. The apparatus according to claim 6, wherein selecting the first refrigerant position and actuating the recover function select switch will open the inlet valve and energize the compressor of the first processing unit.

8. The apparatus according to claim 6, wherein selecting the first refrigerant position and actuating the recover function select switch will open the inlet valve and energize the compressor of the first processing unit; then actuating the evacuate function select switch will turn off the compressor and close the inlet valve of the first processing unit while turning on the vacuum pump and opening the first vacuum valve.

9. The apparatus according to claim 6, wherein selecting the first refrigerant position and actuating the recover function select switch will open the inlet valve and energize the compressor of the first processing unit; then actuating the evacuate function select switch will turn off the compressor and close the inlet valve of the first processing unit while turning on the vacuum pump and opening the first vacuum valve; then actuating the recharge function select switch will turn off the vacuum pump, close the first vacuum valve, and open the outlet valve of the first processing unit.

* * * * *